United States Patent [19]

Nabarrete

[11] Patent Number: 4,795,178

[45] Date of Patent: Jan. 3, 1989

[54] SAILBOARD CARRIER SYSTEM

[76] Inventor: Lance Nabarrete, 1750 Piikea St., Honolulu, Hi. 96818

[21] Appl. No.: 12,145

[22] Filed: Feb. 6, 1987

[51] Int. Cl.[4] ..... B62B 11/00

[52] U.S. Cl. ..... 280/47.13 B; 280/404; 280/414.1; 414/462; 224/331; 224/324; 211/60.1

[58] Field of Search ..... 280/47.13 B, 47.13 R, 280/404, 414.1; 224/324, 329, 331, 917; 114/344; 441/74, 462; 211/60.1, 13

[56] References Cited

U.S. PATENT DOCUMENTS

| | | | |
|---|---|---|---|
| 2,636,745 | 4/1953 | Cartwright | 280/43.18 |
| 4,058,243 | 11/1977 | Tappan | 414/462 X |
| 4,084,735 | 4/1978 | Kappas | 224/329 X |
| 4,214,774 | 7/1980 | Kluge | 280/652 |
| 4,323,182 | 4/1982 | Btot | 224/324 X |
| 4,383,627 | 5/1983 | Ingram | 224/324 X |
| 4,544,172 | 10/1985 | Poulouin | 280/47.13 B |
| 4,561,667 | 12/1985 | Allia | 280/47.13 B |
| 4,602,802 | 7/1986 | Morgan | 280/47.13 B |

FOREIGN PATENT DOCUMENTS

| | | |
|---|---|---|
| 2640236 | 3/1978 | Fed. Rep. of Germany . |
| 3114144 | 10/1982 | Fed. Rep. of Germany . |
| 2309373 | 11/1976 | France . |

*Primary Examiner*—David M. Mitchell
*Assistant Examiner*—Tamara L. Finlay
*Attorney, Agent, or Firm*—Christensen, O'Connor, Johnson & Kindness

[57] ABSTRACT

A wheeled crossmember assembly (12) and an unwheeled crossmember assembly (16) of a carrier system (10) are detachably clamped in spaced apart locations to the mast of a sailboard. The sailboard and associated components are straped to the crossmember assemblies. Ground engaging wheels (14) are detachably attached to crossmember assembly (12). The end of the mast adjacent crossmember assembly (16) is lifted and either pulled or pushed to transport the sailboard, with the mast acting as the tongue of the carrier system. A pair of rail assemblies (20) are mountable on a standard vehicle top rack for sliding reception of crossmember assemblies (12,16) thereby to transport the carrier system (10) together with the sailboard on the top of a vehicle.

18 Claims, 4 Drawing Sheets

SAILBOARD CARRIER SYSTEM

FIELD OF THE INVENTION

The present invention concerns sailboards, and more particularly, to a system for carrying sailboards either as a wheeled trailer buoyant device or in conjunction with a vehicle rooftop rack.

BACKGROUND OF THE INVENTION

The popularity of sailboarding has increased dramatically over the past several years. In this sport, a sailor is supported on an elongate board which may range from about three to four meters in length and from about ten to twenty kolograms in weight. An elongate mast is detachably mounted on the board typically with a universal-type joint. The mast may range from about three and one-half to six meters in length. A sail is mounted on the mast together with a generally wishbone-shaped boom assembly that extends rearwardly from an intermediate location of the mast. To rig the sail, a downhaul is employed to secure the tack portion of the sail to the lower end of a mast. Also, a lower outhaul is employed to attach the clew of the sail to the rear portion of the boom. The term "sailboard" will be used herein to refer to either a complete unit or only to the board.

A sailboard is transported about with the above-identified components in disassembled condition. Often the sailboard and associated components are carried on a rooftop rack mounted on top of the sailor's automobile or other vehicle. After driving to a desired sailing location, the sailboard and associated components must be carried to the water and assembled. This can be a laborious, time-consuming procedure in that the sailor's vehicle not infrequently must be parked a considerable distance away from the water's edge. Several trips may be required to carry all of the sailboard components from the sailor's vehicle to the water and vice versa.

Various devices have been proposed for use in transporting a sailboard to the water's edge. For example, U.S. Pat. No. 4,561,667 discloses a rack cart constructed with upstanding frame on which is set the sailboard, mast, sail and other components. A short handle extends rearwardly from the frame cart to lift the rear portion of the frame and push it in the forward direction.

As a further example, U.S. Pat. No. 4,544,172 discloses a wheeled assembly having longitudinally spaced apart, upwardly and downwardly open couplers for receiving the mast which is wedged into the couplers. A majority of the length of the mast extends forwardly of the wheeled assembly. The wishbone boom is set on top of the wheel assembly and then the sailboard is placed thereon. The mast serves as the tongue of the wheel assembly for towing the sailboard.

SUMMARY OF THE INVENTION

The present invention provides an integrated system for transporting a sailboard on a vehicle and also along the ground, for instance, from the parking location of the vehicle to the water's edge and vice versa. The sailboard carrier system of the present invention includes a first, wheeled crossmember assembly for underlying and supporting the sailboard. The first crossmember assembly includes a sail supporting first crossmember, support legs extendible downwardly from the first crossmember and wheels mounted on the lower portions of the support legs. The upper portions of the support legs are detachably attached to the first crossmember to enable the wheels to be removed when the carrier system of the present invention is mounted on top of a vehicle. A clamping system is provided for detachably attaching the first crossmember assembly to the mast of the sailboard.

The first crossmember assembly also includes a first retainer for slidably engaging with longitudinal rail assemblies mountable on a vehicle top rack. The retainers include pins extending downwardly from the crossmembers to engage within slots formed in the rail assemblies. The rail assemblies include retention mechanisms for engaging with the retainer pins to secure the first crossmember assembly to the rail assemblies.

The present invention may also include a second crossmember assembly detachably securable to the mast at a location spaced from the wheeled crossmember assembly. The second crossmember assembly cooperates with the first crossmember assembly to underlie and support the sailboard at two separate locations along the length of the sailboard. The second crossmember assembly is constructed essentially identically to the first crossmember assembly and is adapted to receive the support legs if it is desired to change the location of the ground engaging wheels from the first to the second crossmember assembly.

In accordance with a further aspect of the present invention, a skid brake is detachably mountable on the sailboard mast to restrict the travel of the carrier system of the present invention, for instance, when negotiating an incline. The skid brake includes a ground engaging skid member and a clamping assembly for detachably clamping the skid member to the mast at the end opposite that grasped by the user. To apply the skid brake, the end of the mast held by the user is lifted upwardly, thereby to pivot the mast about the ground engaging wheels and force the skid brake downwardly into engagement with the ground.

BRIEF DESCRIPTION OF THE DRAWINGS

The details of typical embodiments of the present invention will be described in connection with the accompanying drawings, in which.

DETAILED DESCRIPTION

Figure 1:
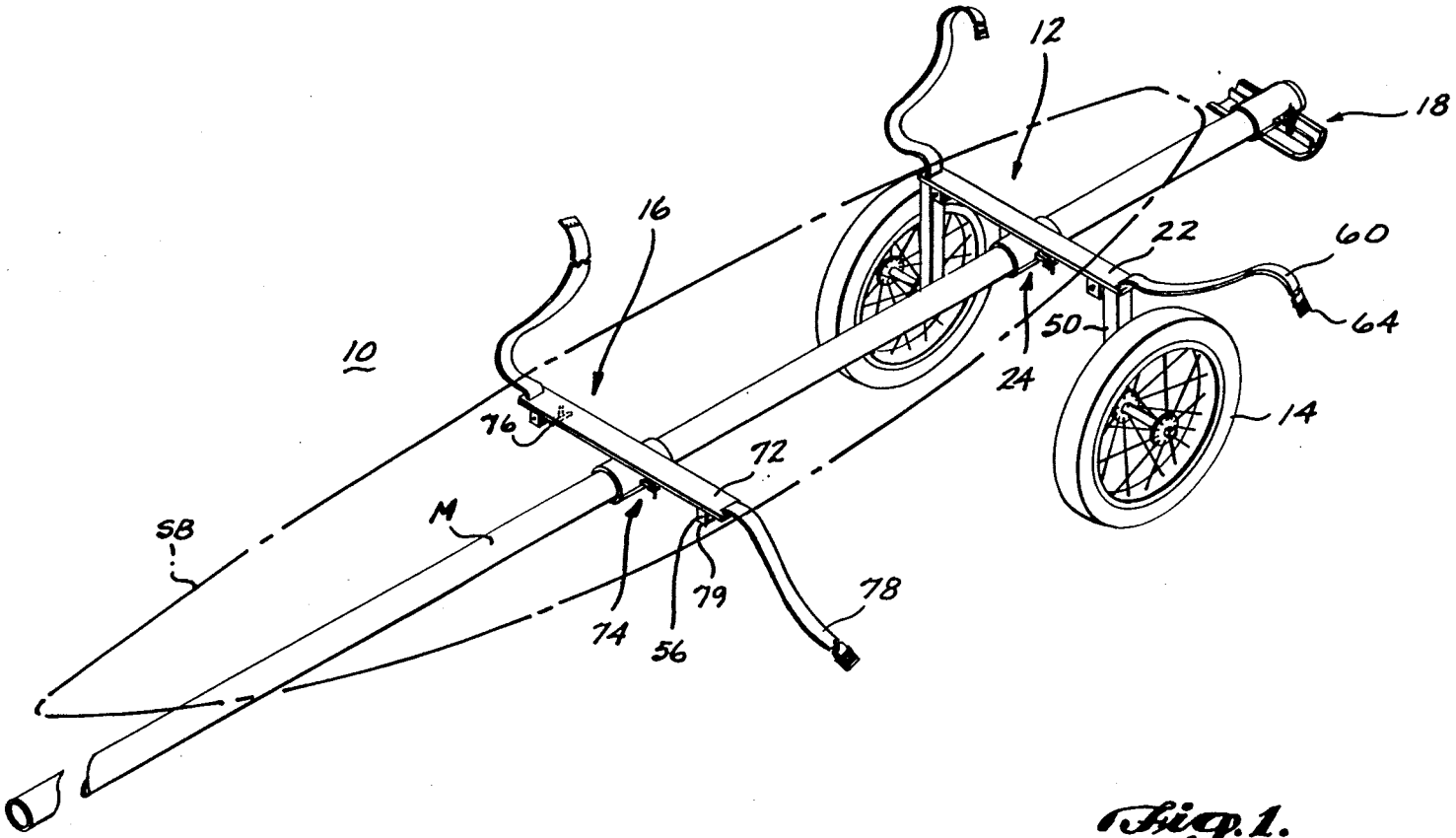
FIG. 1 is an isometric view of the present invention assembled with a sailboard mast as a wheeled carrier for a sailboard and associated equipment.
Figure 4:
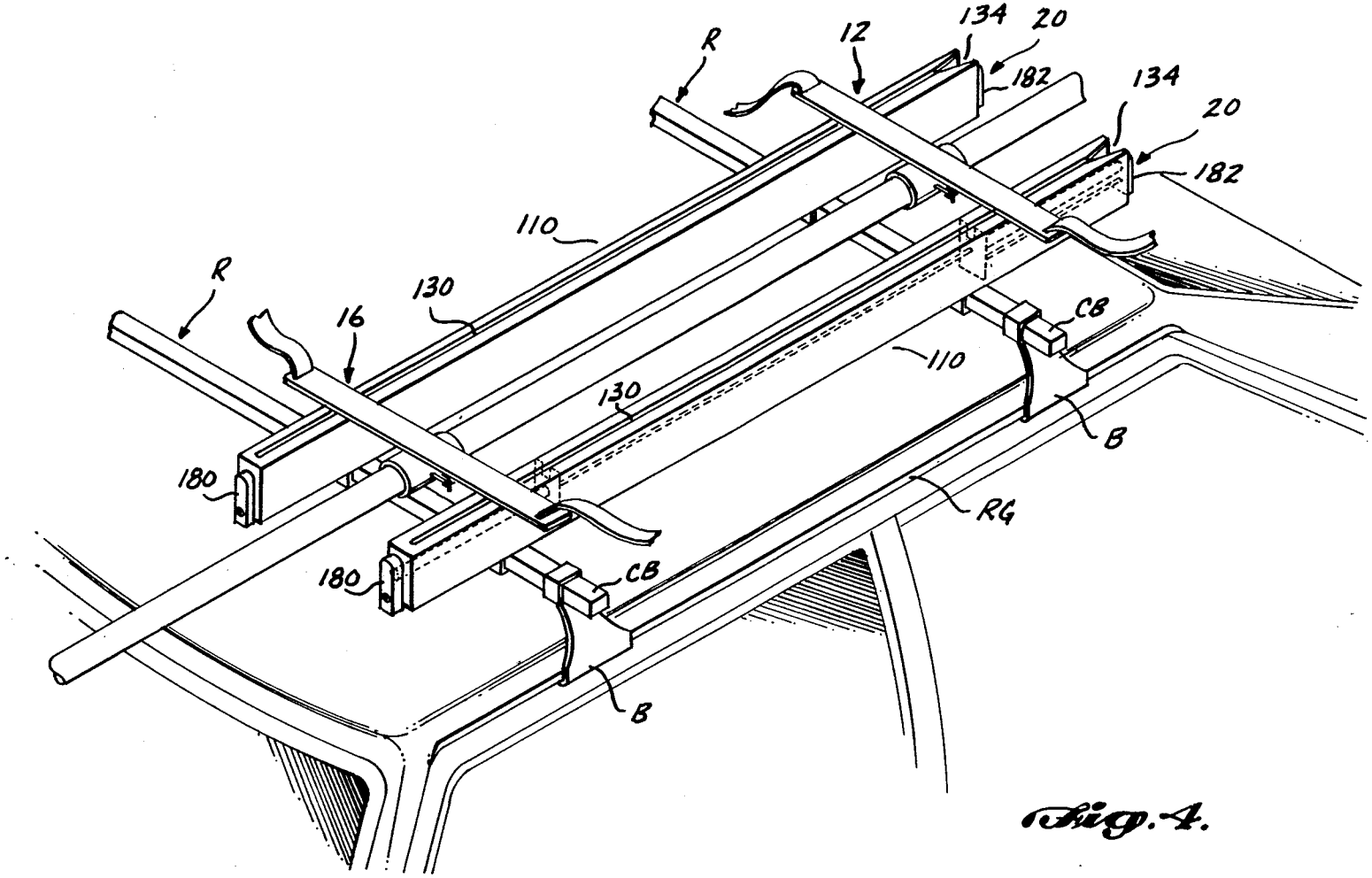
FIG. 4 is an isometric view illustrating the rail assemblies mounting the sailboard carrier of the present invention on the roof racks of a transport vehicle.

Initially referring to FIG. 1, a convertible sailboard carrier system 10 constructed according to the present invention is illustrated in FIG. 1 as assembled in a wheeled trailer configuration to support and carry a sailboard SB thereon. The carrier system 10 includes a first, rearward, wheeled crossmember assembly 12 detachably secured to an intermediate portion of the mast M of the sailboard SB and supported by ground engaging wheels 14. A second, forward unwheeled crossmember assembly 16 is detachably secured to mast M at a location spaced forwardly of crossmember assembly 12. A skid brake 18 is detachably secured to the end portion of the mast M extending rearwardly from crossmember assembly 12. Referring additionally to FIG. 4, a pair of rail assemblies 20 are provided for mounting the carrier system 10 on transverse racks R located on the roof of a vehicle. For convenience in describing the present invention, the end of the mast M at the right side of FIG. 1 will be referred to as the rear end whereas the opposite end of the mast will be referred to as the forward end. It is to be understood that either end could serve as the forward end depending on which end of the carrier system 10 is pulled or pushed by the sailor.

Figure 2:
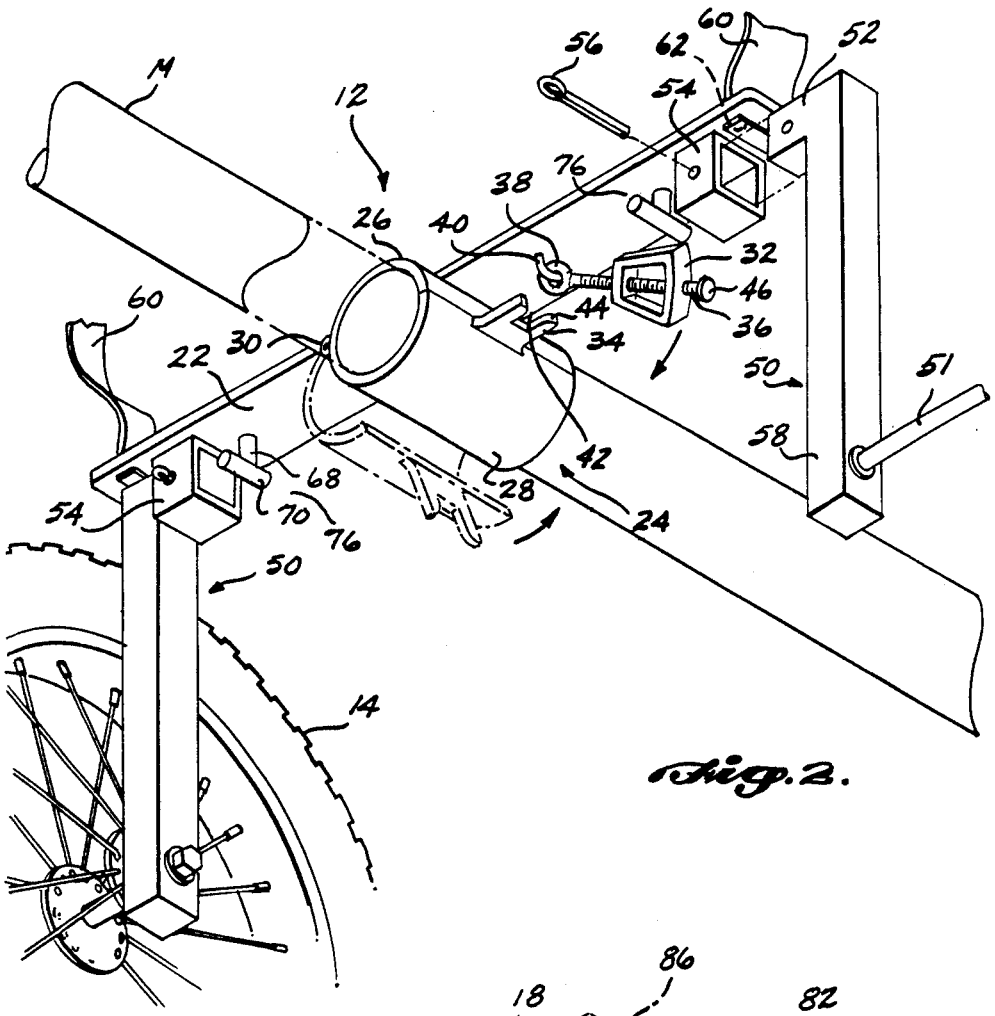
FIG. 2 is an enlarged, fragmentary, partially exploded isometric view illustrating a crossmember assembly of the carrier system of the present invention.

Next considering the above-identified major components of the present invention in more detail, as most clearly shown in FIGS. 1 and 2, the first, wheeled crossmember assembly 12 includes a transverse crossbar 22 for underlying and supporting the rearward portion of sailboard SB. The crossbar 22 is detachably secured to an intermediate portion of mast M with a clamp assembly 24. The clamp assembly 24 includes an upper, arcuate section 26 attached to a lower arcuate section 28 by a hinge 30 to allow the lower section to open and close relative to the upper section. The upper clamp section 26 is fixedly secured to the underside of crossbar 22 by any convenient method, such as by weldments, to extend transversely to the crossbar. The upper and lower sections of clamp assembly 24 are shaped and sized to receive and tightly close against an intermediate portion of mast M by engagement of a thumb nut 32 with a slotted lug 34 extending transversely from the side portion of lower clamp section 28 opposite hinge 30. Thumb nut 32 is threadably engaged with an elongated pin 36 which is swivel-mounted to the underside of crossbar 22. Pin 36 is formed with an enclosed eye 38 engaged with a generally U-shaped link member 40 depending downwardly from the underside of crossbar 22. It will be appreciated that by this construction pin 36 and thumb nut 32 can be conveniently pivoted into engagement with and out of engagement from lug 34 when closing and opening, respectively, clamp assembly 24. Lug 34 is formed with a slot 42 having a width to closely receive pin 36. ideally, the end portions of lug 34 leading into slot 42 are beveled at 44 to facilitate the entry of pin 36 into slot 44. Also, ideally the end of pin 36 opposite eye 38 is formed with an enlarged head 46 to prevent the accidental disengagement of thumb nut 32 from the pin.

Still referring to FIGS. 1 and 2, detachable legs 50 extend downwardly from the outer end portions of crossmember assembly 12. Ground engaging wheels 14 are axled to the lower portions of legs 50 by axle stands 51. Each leg 50 is generally formed in an inverted L-shape with a shorter, upper section 52 extending horizontally outwardly from a close-fitting collar 54 fixedly secured to the underside of the end portions of crossbar 22. A pin, such as cotter key 56, extends through aligned through holes formed in collar 54 and leg upper section 52 thereby to retain leg 50 in engagement with the collar when desired. Each leg 50 also includes an elongate upright section 58 extending downwardly from the shorter, horizontal, upper section 52 to engage wheel 14. Although legs 50 are illustrated as constructed from square tubular material, they can be formed from materials of other shape, such as round tubular material or flat barstock, without departing from the spirit or scope of the present invention. It will be appreciated that the shape of collar 54 may be conveniently formed to correspond with the external shape and size of leg upper section 52.

Flexible, adjustable length straps 60 are attached to the outer end portions of crossbar 22 to secure the sailboards SB to the crossbar. As one method of attachment, slots 62 are formed in the outer end portions of crossbar 22 through which straps 60 extend. The straps may be secured to crossbar 22 by any convenient method, such as by doubling the end portion of strap 60 extending through slots 62 over on itself and then stitching such end portion to the strap. A conventional buckle 64 may be secured to the free end of one of the straps 60 for detachable connection to the free end portion of the opposite strap.

As most clearly shown in FIG. 2, a pair of retainers 66 depend downwardly from the underside of crossbar 22 at locations between collars 54 and clamp assembly 24. Each of the retainers 66 is constructed from an upright pin section 68 welded or otherwise fixedly secured to the underside of crossbar 22. A lower cross section 70 extends transversely to the bottom of pin section 68 in the direction substantially parallel to the length of clamp assembly 24. Ideally, pin section 68 and lower cross section 70 are formed of the same width or diameter.

As illustrated in FIG. 1, the second, forward unwheeled crossmember assembly 16 is constructed identically to the first, rearward wheeled crossmember assembly 12 but without legs 50. As such, the construction of forward crossmember assembly 16 will only be briefly described. As with rear crossmember assembly 12, forward crossmember assembly 16 include a transverse crossbar 72 for underlying and supporting the forward end portion of sailboard SB. The crossmember assembly 16 includes a clamp assembly 74 and retainers 76 that are ideally constructed identically to the corresponding components of crossmember assembly 12. Also, straps 78 are attached to the outer end portions of crossbar 72 in a manner similar to straps 60 of the rear crossmember assembly. Further, collars 79 formed identically to collars 54 are fixedly secured to the underside of the end portions of cross bar 72 to receive the upper section 52 of detachable legs 50. The legs are detachably secured to collars 54 by a pin, for instance similar to cotter key 56, that extends through aligned holes formed in collar 79 and leg upper section 52.

By constructing crossmember assembly 16 in the manner discussed above, legs 50 may be engaged with either crossmember assembly 12 or 16 depending upon whether the carrier system 10 is operated by pulling or pushing, whether traveling up or down a grade, whether or not skid brake 18 is employed, and other factors discussed infra. As shown in FIG. 1, when crossmember assembly 16 is detachably clamped to mast M at a location spaced from the crossmember assembly 12, the two crossmember assemblies conveniently and securely support and carry sailboard SB and its associated components, including, a wishbone boom, sail and rigging, not shown.

Figure 3:
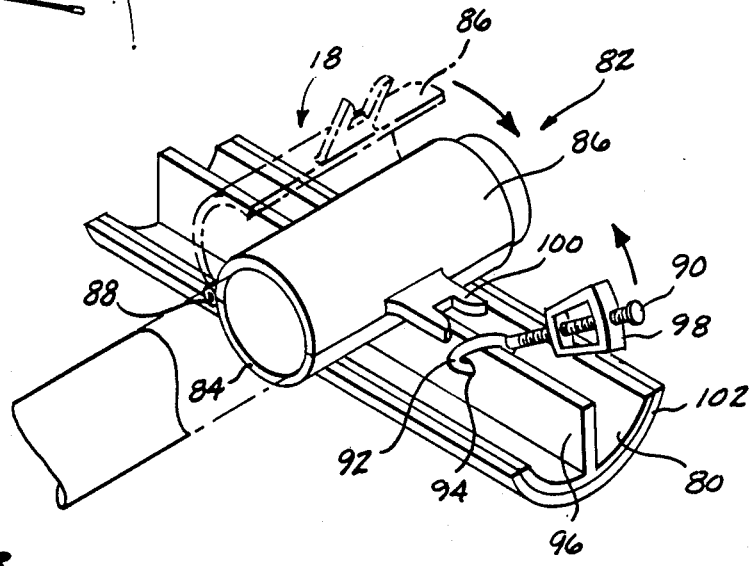
FIG. 3 is an enlarged, isometric, partially exploded view specifically illustrating a skid brake used in conjunction with the present invention.

Next referring to FIGS. 1 and 3, a skid brake 18 is adapted to be detachably secured to one end of mast M. The skid brake 18 is constructed with an elongate skid pad 80 disposed transversely to a clamp assembly 82, which is adapted to receive mast M therein. Ideally, clamp assembly 82 is constructed essentially identically to clamp assemblies 24 and 74 with the exceptions noted below. The clamp assembly 82 includes an elongate, generally semicircular section 84 fixedly secured to skid pad 80 by weldments or other convenient method. The clamp assembly also includes a movable section 86 attached to fixed section 84 by a hinge 88. Movable section 86 is held in closed position with a pin 90 which is constructed identically to pin 36 with the exception that the eye 92 of the pin 90 extends through a hole 94 formed in central wall 96 of skid pad 80. It will be appreciated that to engage pin 90 with hole 94, eye 92 may initially be formed with an opening therein, not shown, with such opening being closed, such as by welding, after engagement of the eye 92 with hole 94. As a possible alternative, a slot, now shown, could be formed in center wall 96 leading from the adjacent edge of the center wall to hole 94, with such slot clsoed, as by welding, after engagement of eye 92 within hole 94. A thumb nut 98 is threadably engaged on pin 90 to bear against a lug 100 extending transversely outwardly from the adjacent edge portion of clamp movable section 86.

As illustrated in FIGS. 1 and 3, preferably skid pad 80 is formed in a generally semicircular cross section; although, it may be formed in other cross-sectional shapes without departing from the spirit or scope of the present invention. Although not essential, a central wall 96 extends centrally along the concave side of skid pad 80 to increase the structural integrity of skid brake 18. Also, preferably a wear pad 102 is bonded or otherwise fixedly attached to the convex surface of skid pad 80 to rub against the ground when the skid brake is applied. Ideally, the wear pad is formed from tough, durable material that exhibits relatively high coefficient of friction with the ground. Illustrative, but not limiting examples of such materials include high durometer neoprene, urethane, or rubber. It will be understood that increased frictional contact with the ground may be achieved by methods other than employing wear pad 102, for instance, by forming skid pad 80 with outwardly directed projections, not shown, or by constructing the skid pad from expanded metal material, not shown.

Figures 5, 6:
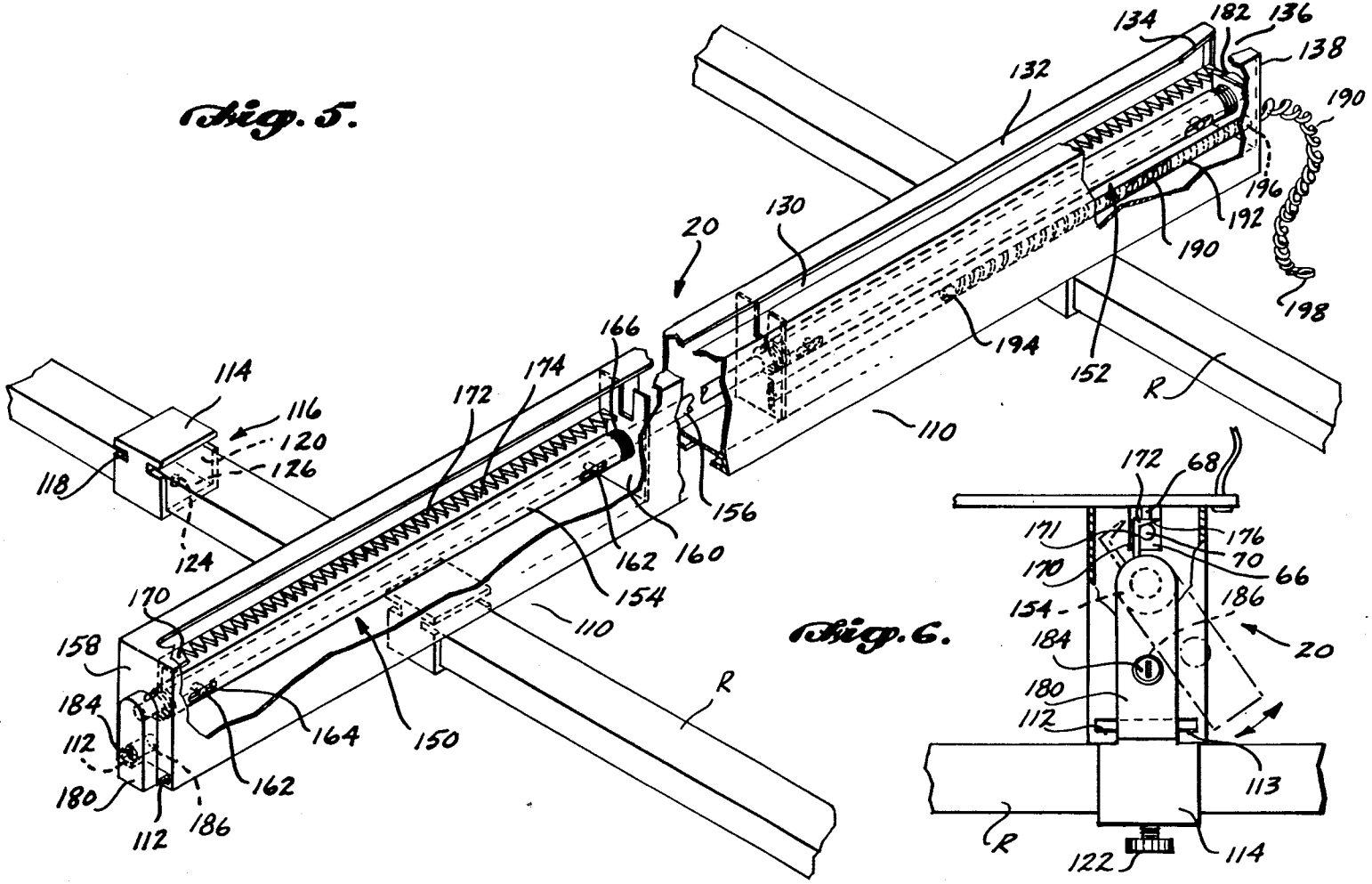
FIG. 5 is an enlarged, fragmentary, isometric view of one of the rail assemblies shown in FIG. 4, with portions broken away for clarity; and, FIG. 6 is an end elevational view of the rail assembly shown in FIG. 5 specifically illustrating a rail handle in locked and unlocked positions.

Next referring to FIGS. 4 through 6, a pair of elongate rail assemblies 20 are mounted on transverse racks R of a typical vehicle rooftop carrier whereby the carrier system 10 of the present invention may be conveniently transported from place to place by an automobile or similar vehicle. As shown in FIG. 4, the racks R include a rectangular crossbar CB which engage and are supported by brackets B attached to the rain gutter RG of the vehicle. Racks, such as rack R shown in FIG. 4, are widely commercially available.

Rail assemblies 20 include elongate, substantially enclosed, generally rectangularly-shaped box-type housings 110 having a generally hollow interior. A pair of bottom flanges 112 extend inwardly from the lower side edges of housing 110 at an elevation spaced below the housing to define a gap 113 therebetween that functions as a keyway for slidably receiving the upper wall section 114 of coupling collars 116 that function as keys, FIGS. 5 and 6. Slots 118 are formed in the upper portion of the coupling collars to slidably receive flanges 112. The gap 113 is open at the front ends of housing 110 to enable the housings to engage the coupling collars 116, but is closed at the rear of the housings to prevent disengagement of the coupling collars from the rear of the housings.

The coupling collars each have a generally rectangularly-shaped through opening 120 for closely and slidably receiving crossbar CB. It can be appreciated that if crossbar CB is formed in other cross-sectional shapes, such as circular, then the interior opening 120 of coupling collar 116 is to be formed in a corresponding shape. A thumb screw 122 extends upwardly through a threaded opening 124 formed in the bottom wall 126 of the coupling collar 116 to bear against the underside of crossbar CB. As a result, the upper surface of the rack presses against the lower surfaces of flanges 112 and the upper surfaces of the flanges 112 bear against the upper wall section of the coupling collar 116 to prevent relative movement not only between the corssbar CB and the coupling collars, but also between the coupling collars and the housing 110. It can be appreciated that by this construction, the spacing between rail assemblies 20 can be conveniently adjusted by simply loosening thumb screws 122, sliding coupling collars 116 along crossbar CB and then retightening the thumb screws. Likewise, the longitudinal positions of the rail assemblies can be conveniently adjusted by loosening thumb screws 122, sliding the rail assemblies lengthwise relative to the coupling collars 116 and then simply retightening the thumb screws.

An elongate, narrow slot 130 extends centrally along the upper wall 132 of housings 110. At the rearward end of housings 110, slot 130 is beveled outwardly at 134 to intersect a downwardly extending slot 136 formed in rear wall 138 of the housing. Ideally, the width across slot 130 is greater than the diameter or width of pin sections 68 and transverse sections 70 of retainers 66 to slidably receive the pin sections and not prevent the retainers from disengaging from the slot, for instance, if one end of the carrier system 10 is accidentally dropped when loading the carrier system onto or removing the carrier system from the rail assemblies, as discussed more fully below. This will help prevent damage to the carrier system, mast m or rail housings 110. It will be appreciated that the engagement of pin sections 68 of retainers 66 into a corresponding slot 130 is facilitated by bevels 134.

Referring specifically to FIGS. 4 and 5, forward and rearward retention mechanisms 150 and 152, respectively, secure crossmember assemblies 16 and 12 to rail assemblies 20 by detachably engaging retainers 66. Except for some minor variations, the forward and rearward retention mechanisms are constructed essentially identical to each other and, thus, only the forward retention mechanisms will be described in detail with the understanding that such description also pertains to the rearward retention mechanism 152. As shown in FIG. 5, retention mechanism 150 is constructed with an elongate tube 154 supported by a rod 156 slidably engaged within the tube. Rod 156 also extends through aligned openings formed in forward wall 158 of rail housing 110 and a forward intermediate wall 160 disposed within the interior of the rail housing. The forward intermediate wall 160 may be placed within the rail housing by, for instance, forming an opening in the bottom of the housing and then closing the opening, such as by welding. A crosspin 162 extends transversely outwardly from rod 156 to transversely engage aligned, longitudinally extending slots 164 formed in diametrically opposite sides of tube 154 at both end portions of the tube. Crosspins 162 may be attached to rod 156 by any convenient means, for instance, by driving the crosspins through a snug-fitting crosshole, not shown, formed in rod 156. It will be appreciated that crosspins 162 permit tube 154 to slide longitudinally relative to rod 156 and rail housing 110 while transmitting torque between the tube and rod 156. To allow such longitudinal movement of tube 154, the length of the tube is somewhat shorter than the longitudinal distance separating housing forward wall 158 and forward intermediate wall 160. Tube 154 is nominally spaced from and centered relative to the forward wall 158 and the forward intermediate wall 160 by a pair of compression springs 166 engaged over rod 156 and disposed between the ends of tube 154 and the housing forward wall 158 and the housing forward intermediate wall 160.

A generally L-shaped, elongated, longitudinally extending bar 170 has an upright section 171 extending upwardly from the upper portion of tube 154 at a location offset from the rotational center of the tube. Bar 170 also includes a plurality of V-shaped teeth 172 extending horizontally from the bar upright section 171 and across the longitudinal center line of the tube. Adjacently located teeth 172 define a V-shaped gap 174 for engagement with the pin sections 68 of retainers 66 at a location adjacent the lower cross sections 70 of the retainer 66. In side profile, teeth 172, as shown in FIG. 5, are tapered in the direction leading away from the upright section 171 so that as bar 170 is rotated in the clockwise direction from a disengaged position to an engaged position, as shown in FIG. 6, a clearance initially exists between the underside 176 of teeth 172 and the adjacent portion of retainer lower transverse section 70, which clearance is closed by the time bar 170 has been rotated into the fully engaged position so that the underside 176 of the teeth 172 bear against the upper surface of retainer transverse section 70 thereby to securely hold the underside of crossbars 22 and 72 against the upper walls 132 of the rail assembly housings 110. Bar 170 may be attached to tube 154 by any convenient method, such as by welding.

It will be appreciated that by the above construction, retention mechanisms 150 and 152 are adapted to accommodate mismatches between teeth gaps 174 and retainers 66 which could occur, for instance, if the crossmember assemblies 12 and 16 are not positioned precisely perpendicularly to the length of mast M. As tube 154 and its associated bar 170 are rotated into engaged position, if a tooth gap 174 is not in precise alignment with the pin section 68 of a retainer 66, tube 154 simply slides longitudinally relative to rod 156 thereby to place pin section 68 into locking engagement between two adjacent teeth 172 of the bar 170.

As shown in FIGS. 4, 5 and 6, forward and rearward handles 180 and 182 are attached to the adjacent end portions of rod 156 which extend outwardly beyond forward wall 158 and rearward wall 138 of rail assembly housing 110. The manually graspable forward handle 180 and rearward handle 182 enable the retention mechanisms 150 and 152 to be conveniently shifted between engaged and disengaged positions shown in FIG. 6. A push-type lock 184 is mounted on handles 180 and 182 to engage within aligned openings 186 formed in forward wall 158 and rearward wall 138 of rail assembly housing 110. Push-type locks, such as lock 184, are standard articles of commerce. Locks 184 are engaged within corresponding openings 186 by pressing inwardly against the lock and are disengaged from the opening by use of a key, not shown. It will be appreciated that locks 184 only prevent removal of crossmember assemblies 12 and 16 from the rail assemblies 20. Moreover, the locks 184 that are mounted on the forward handles 180 also prevent disengagement of the rail assemblies 20 from corresponding coupling collars 116 by virtue of the lower portions of handles 180 extending downwardly to an elevation below slots 113 within which the upper wall sections 114 of the coupling collars 116 are engaged. As discussed above, since slots 113 are closed off at the rear ends of the rail assemblies 20, the coupling collars 116 cannot be disengaged from the rear ends of the rail assemblies.

As illustrated in FIG. 5, the present invention may also include a flexible anchor cable 190 engaged within an elongate tube 192 disposed within the interior of the rear portion of housing rail assembly 110. A collar 194 is secured to the inward end of cable 190 to bear against a reduced diameter end neck 196 formed in the rearward end of the tube 192 to prevent detachment of the cable from rail assembly 20. An eye 198 is formed in the free end portion of cable 190 for attachment with a locking mechanism, not shown, of the type commonly employed in conjunction with sailboards.

As one manner of utilizing the present invention, rail assemblies 20 are initially mounted on the vehicle racks R by engagement of coupling collars 116 over the crossbars CB and within the gaps 113 formed in the underside of rail assembly housings 110. When the rail assemblies 20 are positioned at the desired locations on racks R, thumb screws 122 are simply tightened. Next, crossmember assemblies 12 and 16 are clamped to mast M at spaced apart locations thereon. The sailboard SB and associated components such as a boom, sail, etc. are placed on the crossmembers and held in place by straps 60 and 78. The carrier system 10, sailboard SB, mast and associated components are conveniently mounted on rail assemblies 20 by sliding engagement of the crossmember assemblies 12 and 16 with the rail assemblies by insertion of retainers 66 into slots 130 formed in the upper walls 132 of the rail assembly housings 110. After the sailboard SB has been placed at the desired location along the length of the rail assemblies 20, handles 180 and 182 are rotated from the open position to the closed or locked position as shown in FIG. 6, whereupon the teeth 172 of bar 170 engage retainers 66 thereby to secure the crossmember assemblies to the rail assemblies. The sailboard is now ready to transport to a desired location.

Upon reaching the desired destination, the sailboard is conveniently removed from the vehicle by rotating handles 180 and 182 from their closed or locked position to their open position as shown in FIG. 5, thereby to disengage teeth 172 from retainers 66. Thereafter, crossmember assemblies 12 and 16 may be slidably disengaged from the rail assemblies 20 and the carrier system 10 together with the sailboard SB lowered to the ground. Either before or after lowering the sailboard SB from the rail assemblies, wheels 14 may be attached to crossmember assembly 12 by engagement of the upper sections 52 of legs 50 into associated collars 54. The end of mast M adjacent crossmember 16 is then simply lifted to either pull or push carrier system 10 to the water's edge, with the mast serving as the tongue of the carrier system for transport of the sailboard over the ground.

If the sailboard SB is to be transported down an incline from the parking location of the vehicle to the water's edge, then skid brake 18 may be mounted on the end of mast M opposite the end held by the user when pulling or pushing the carrier system 10. Skid brake 18 is applied by simply lifting upwardly on the end of the mast being held by the user thereby pushing the skid brake downwardly against the ground. It will be appreciated that use of the skid brake in this manner makes the journey to the water's edge and back safer and less tiresome. Preferably when skid brake 18 is utilized, wheels 14 are attached to crossmember assembly 16 rather than to crossmember assembly 12 so that the distance between the wheels and the skid brake is increased. As a result, the end of the mast M being held by the user need not be raised as high off the ground to apply the skid brake 18.

As will be apparent to those skilled in the art to which the invention is addressed, the present invention may be embodied in forms other than those specifically disclosed above without departing from the spirit of central characteristics of the invention. The particular embodiments of the carrier system 10 described above, are therefore to be considered in all respects as illustrative and not restrictive. The scope of the present invention is as set forth in the appended claims, rather than being limited to the examples of the carrier system 10 set forth in the foregoing description.

The embodiments of the invention in which an exclusive property or privilege is claimed are defined as follows:

I claim:

1. A sailboard carrier system, comprising:

a. a first sailboard supporting crossmember to support the underside of the sailboard;

b. support legs extendible downwardly from said first crossmember;

c. means for detachably attaching the upper portions of said support legs to said first crossmember;

d. ground engaging wheels mounted on said support legs;

e. a first attachment assembly carried by said first crossmember to detachably attach said first crossmember to a sailboard mast at selected locations along the length of the mast, said first attachment assembly configured to singularly retain said first crossmember from rotating about or sliding along the mast;

f. first retaining means associated with said first crossmember for detachably retaining said first crossmember on a vehicle rooftop carrier with the sailboard attached to said first crossmember and the sailboard mast attached to said first crossmember by said first attachment assembly;

g. a second sailboard supporting crossmember;

h. a second attachment assembly carried by said second crossmember for detachably attaching said second crossmember to the sailboard mast at selected locations along the length of the mast relative to the location of said first crossmember, said second attachment assembly configured to singularly retain said second crossmember from rotating about or sliding along the mast;

i. said first and second attachment assemblies detachably attaching said first and second crossmembers, respectively, to the mast without attachment of said first and second crossmembers directly to each other; and, j. second retaining means associated with said second crossmember for detachably retaining said second crossmember on the vehicle rooftop carrier with the sailboard attached to said second crossmember and the sailboard mast attached to said second crossmember by said second attachment assembly.

2. The sailboard carrier system according to claim 1, wherein said first attachment assembly for detachably attaching said first crossmember to said sailboard mast comprises first clamping means encircling the mast.

3. The sailboard carrier system according to claim 1, wherein said second attachment assembly for detachably attaching the second crossmember to the mast includes clamping means encircling the mast.

4. The sailboard carrier system according to claim 1, wherein the first and second crossmembers are of substantially identical construction.

5. The sailboard carrier system according to claim 1, further comprising a vehicle rooftop carrier, comprising:

a pair of longitudinal rail assemblies having portions slidably receiving the first and second retaining means of said first and second crossmembers, respectively, to guide the first and second crossmembers for movement along the rail assemblies during the mounting of the sailboard onto the rooftop carrier and dismounting of the sailboard from the rooftop carrier; and, locking means associated with said rail assemblies to engage said first and second retaining means of said first and second crossmembers, respectively, to securely lock said first and second crossmembers to said rail assemblies.

6. The sailboard carrier system according to claim 5, wherein said locking means having portions to shift said locking means along the length of said rail assemblies in response to the location of the first and second retaining means relative to said rail assemblies.

7. The sailboard carrier system according to claim 5, wherein the first and second retaining means of the first and second crossmembers, respectively, include pin means depending from said crossmembers; and, said rail assembly having slots extending therealong for receiving said pin means and guiding said crossmembers for sliding movement along said rail assemblies.

8. The sailboard carrier system according to claim 7, wherein said locking means including engagement means to engage said pin means to secure said pin means to said rail assemblies.

9. The sailboard carrier system according to claim 8, wherein:

(a) said rail assemblies include substantially hollow rail members; and, (b) said locking means are disposed within said rails.

10. A sailboard carrier system comprising:

(a) a first sailboard supporting crossmember;

(b) support legs extendible downwardly from said first crossmember;

(c) means for detachably attaching the upper portions of said support legs to said first crossmember;

(d) ground engaging wheels mounted on said support legs;

(e) first means for detachably attaching said first crossmember to a sailboard mast;

(f) first retaining means for detachably retaining said first crossmember on a vehicle rooftop carrier; and, (g) a skid brake for restricting the travel of the carrier system while supporting and carrying a sailboard, said skid brake comprising:

a ground engageable skid member; and, means for attaching said skid member to a selected location along the length of said mast.

11. The sailboard carrier system according to claim 10, wherein said skid member extends generally transversely to the mast.

12. The sailboard carrier system according to claim 10, wherein the means to attach the skid member to the mast includes a clamping system encircling the mast.

13. A sailboard carrier system for use with a vehicle top rack composed of a pair of bar members extendible transvsersely across the top of a vehicle, the carrier system comprising:

(a) a pair of elongate rails;

(b) means for mounting said rails on the bar members to extend generally transversely to the bar members;

(c) first and second crossmembers for underlying and supporting a sailboard;

(d) a first attachment assembly carried by said first crossmember to detachably attach said first crossmember to a mast of the sailboard to singularly retain said first crossmember from rotating about and sliding along the mast;

(e) a second attachment assembly carried by said second crossmember to detachably attach said second crossmember to said mast at selected locations along the mast relative to said first crossmember to singularly retain said second crossmember from rotating and sliding along the mast;

(f) said first and second attachment assemblies detachably attaching said first and second crossmembers, respectively, to the mast without attachment of said first and second crossmembers to each other;

(g) said rails having portions for guiding said crossmembers for sliding movement over said rails with said crossmembers being generally perpendicular to said rails; and, (h) a retaining system associated with each of said rails and said crossmembers for detachably securing said crossmembers to said rails at selected locations along the length of said rails, said retaining systems, comprising:

(i) pin means extending from said crossmembers; and, (ii) a latch assembly associated with said pin means and mounted on a corresponding rail, said latch assembly having engagement means and actuating means for operating said engagement means to engage said engagement means with and disengage said engagement means from corresponding pin means, said actuating means having manually operable means located at the ends of said rails for operating said actuating means, said latch assembly also having means for automatically adjusting the position of said engagement means along its corresponding rail as said latch assembly is being operated in response to the location of said pin means along an associated rail.

14. The sailboard carrier system according to claim 13, wherein:

(a) said rails having portions defining longitudinal slots formed in said rails; and, (b) said pins means depending from said crossmembers to engage within and slide along said rail slots.

15. The sailboard carrier system according to claim 13, further comprising locking means to prevent said rails from being disassembled from the bar members and to lock said latch assembly in engagement with said pin means.

16. The sailboard carrier system according to claim 13, wherein said first and second attachment assemblies detachably secure the saiboard mast to the underside of said crossmembers.

17. The sailboard carrier system according to claim 16, wherein said first and second attachment assemblies independently clampingly engage with the mast.

18. The sailboard carrier system according to claim 13, further comprising:

(a) a plurality of legs;

(b) means for removably attaching said legs to said crossmembers; and, (c) a ground engageable wheel journaled to each of said legs.

* * * * *